US009151157B2

(12) United States Patent
Lehnert et al.

(10) Patent No.: US 9,151,157 B2
(45) **Date of Patent: *Oct. 6, 2015**

(54) CHISEL HOLDER

(75) Inventors: Thomas Lehnert, Oberraden (DE); Karsten Buhr, Willroth (DE); Cyrus Barimani, Königswinter (DE); Günter Hähn, Königswinter (DE); Karl Kammerer, Fluorn-Winzeln (DE); Markus Roth, Aichhalden (DE); Bernhard Diessner, Telfes in Stubai (AT)

(73) Assignee: Wirtgen GmbH (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/822,895

(22) PCT Filed: Dec. 2, 2011

(86) PCT No.: PCT/EP2011/071588

§ 371 (c)(1),
(2), (4) Date: Jun. 7, 2013

(87) PCT Pub. No.: WO2012/072786

PCT Pub. Date: Jun. 7, 2012

(65) Prior Publication Data

US 2013/0241266 A1 Sep. 19, 2013

(30) Foreign Application Priority Data

Dec. 3, 2010 (DE) ..... 10 2010 061 019
Jul. 4, 2011 (DE) ..... 10 2011 051 521

(51) Int. Cl.
*E21C 35/19* (2006.01)
*E21C 35/193* (2006.01)
*E21C 35/18* (2006.01)

(52) U.S. Cl.
CPC ..... *E21C 35/18* (2013.01); *E21C 35/19* (2013.01); *E21C 35/193* (2013.01); *E21C 2035/191* (2013.01)

(58) Field of Classification Search
CPC ... E21C 35/19; E21C 35/193; E21C 35/1933; E21C 35/1936; E21C 35/197; E21C 2035/191
USPC ..... 299/102, 104, 105, 106, 107, 108, 109
See application file for complete search history.

(56) References Cited

U.S. PATENT DOCUMENTS
2,452,081 A 10/1948 Sullinger
3,143,177 A 8/1964 Galorneau et al.

(Continued)

FOREIGN PATENT DOCUMENTS

CA 2742849 A1 5/2010
CN 1942655 A 4/2007

(Continued)

OTHER PUBLICATIONS
U.S. Appl. No. 13/822,720, filed Mar. 13, 2013 to Lehnert et al.
U.S. Appl. No. 13/822,917, filed Mar. 13, 2013 to Lehnert et al.
U.S. Appl. No. 13/989,837, filed Dec. 2, 2011 to Kammerer et al.
U.S. Appl. No. 29/452,133, filed Apr. 12, 2013 to Buhr et al.
U.S. Appl. No. 29/452,136, filed Apr. 12, 2013 to Buhr et al.
U.S. Appl. No. 29/452,137, filed Apr. 12, 2013 to Buhr et al.
U.S. Appl. No. 29/452,139, filed Apr. 12, 2013 to Buhr et al.
DE 102010061019.4 "Examination Report" Oct. 20, 2011, 4 pages.

(Continued)

*Primary Examiner* — David Bagnell
*Assistant Examiner* — Michael Goodwin
(74) *Attorney, Agent, or Firm* — Lucian Wayne Beavers; Patterson Intellectual Property Law, PC

(57) ABSTRACT

The invention relates to a bit holder for an earth working machine, in particular a road milling machine, having a support member onto which an insertion projection is indirectly or directly attached on an insertion projection side, the support member comprising two first and/or two second stripping surfaces that are at an angle to one another, and the support member having a working side that comprises a bit receptacle. In order to achieve a stable and long-lived configuration for such a bit holder, provision is made according to the present invention that the first and/or second stripping surfaces diverge from the insertion projection side toward the working side.

20 Claims, 8 Drawing Sheets

(56) References Cited

U.S. PATENT DOCUMENTS

| | | | | |
|---|---|---|---|---|
| 3,498,677 | A | 3/1970 | Morrow | |
| 3,992,061 | A | 11/1976 | Rollins | |
| 4,180,292 | A | 12/1979 | Persson | |
| 4,240,669 | A | 12/1980 | Rollins | |
| 4,275,929 | A | 6/1981 | Krekeler | |
| 4,302,055 | A | 11/1981 | Persson | |
| 4,415,208 | A | 11/1983 | Goyarts | |
| 4,542,943 | A | 9/1985 | Montgomery, Jr. | |
| 4,650,256 | A * | 3/1987 | Wetzinger | 299/107 |
| 4,693,518 | A | 9/1987 | Sulosky et al. | |
| 4,828,327 | A | 5/1989 | Wechner | |
| 4,915,455 | A | 4/1990 | O'Neill et al. | |
| 5,011,229 | A * | 4/1991 | O'Neill et al. | 299/102 |
| 5,186,575 | A | 2/1993 | Wirtgen | |
| 5,322,351 | A | 6/1994 | Lent | |
| 5,378,050 | A | 1/1995 | Kammerer et al. | |
| 5,529,384 | A | 6/1996 | Ojanen et al. | |
| 5,573,308 | A | 11/1996 | Simons et al. | |
| 5,683,144 | A | 11/1997 | Kammerer et al. | |
| 6,234,579 | B1 | 5/2001 | Montgomery, Jr. | |
| 6,244,665 | B1 | 6/2001 | Bise et al. | |
| 6,619,756 | B1 | 9/2003 | Holl et al. | |
| 6,619,757 | B1 | 9/2003 | Kammerer | |
| 6,644,755 | B1 | 11/2003 | Kammerer | |
| 6,685,273 | B1 | 2/2004 | Sollami | |
| 6,712,431 | B1 | 3/2004 | Bosch et al. | |
| 6,764,140 | B2 | 7/2004 | Carson, Jr. et al. | |
| 6,779,850 | B1 | 8/2004 | Schibeci et al. | |
| 6,854,810 | B2 * | 2/2005 | Montgomery, Jr. | 299/106 |
| 6,866,343 | B2 | 3/2005 | Holl et al. | |
| 7,086,704 | B2 | 8/2006 | Holl et al. | |
| 7,300,115 | B2 | 11/2007 | Holl et al. | |
| D567,270 | S | 4/2008 | Chiang | |
| D574,689 | S | 8/2008 | Holl et al. | |
| D575,610 | S | 8/2008 | Holl et al. | |
| 7,461,903 | B2 | 12/2008 | Tewes et al. | |
| D585,259 | S | 1/2009 | Holl et al. | |
| 7,475,949 | B2 | 1/2009 | Helsel et al. | |
| 7,537,288 | B2 | 5/2009 | Chiang | |
| 7,547,075 | B2 | 6/2009 | Tewes et al. | |
| 7,597,402 | B2 | 10/2009 | Tewes et al. | |
| 7,744,164 | B2 | 6/2010 | Hall et al. | |
| 7,784,875 | B2 | 8/2010 | Holl et al. | |
| 7,922,256 | B2 | 4/2011 | Kammerer et al. | |
| 7,922,257 | B2 | 4/2011 | Kammerer | |
| D638,453 | S | 5/2011 | Buhr et al. | |
| 8,061,783 | B2 | 11/2011 | Keller et al. | |
| D657,648 | S | 4/2012 | Wachsmann | |
| D666,226 | S | 8/2012 | Buhr et al. | |
| D666,641 | S | 9/2012 | Buhr et al. | |
| D666,642 | S | 9/2012 | Buhr et al. | |
| D666,643 | S | 9/2012 | Buhr et al. | |
| D667,854 | S | 9/2012 | Kammerer et al. | |
| D667,855 | S | 9/2012 | Kammerer et al. | |
| D667,856 | S | 9/2012 | Kammerer et al. | |
| D671,578 | S | 11/2012 | Buhr et al. | |
| 8,622,484 | B2 | 1/2014 | Charlton | |
| 8,746,807 | B2 | 6/2014 | Lehnert et al. | |
| 2002/0074850 | A1 | 6/2002 | Montgomery, Jr. | |
| 2004/0051370 | A1 | 3/2004 | Montgomery, Jr. | |
| 2006/0119165 | A1 | 6/2006 | Holl et al. | |
| 2008/0093912 | A1 | 4/2008 | Willoughby | |
| 2009/0085396 | A1 | 4/2009 | Chiang | |
| 2009/0160238 | A1 | 6/2009 | Hall et al. | |
| 2009/0289493 | A1 | 11/2009 | Holl et al. | |
| 2009/0293249 | A1 | 12/2009 | Lehnert et al. | |
| 2010/0045094 | A1 | 2/2010 | Sollami | |
| 2010/0076697 | A1 | 3/2010 | Wagner et al. | |
| 2011/0006588 | A1 | 1/2011 | Monyak et al. | |
| 2011/0148178 | A1 | 6/2011 | Lehnert et al. | |
| 2011/0148179 | A1 | 6/2011 | Lehnert et al. | |
| 2011/0266860 | A1 | 11/2011 | Charlton | |
| 2013/0241264 | A1 | 9/2013 | Lehnert et al. | |
| 2013/0241265 | A1 | 9/2013 | Lehnert et al. | |

FOREIGN PATENT DOCUMENTS

| | | | |
|---|---|---|---|
| CN | 101018927 | A | 8/2007 |
| CN | 101091037 | A | 12/2007 |
| CN | 101175895 | A | 5/2008 |
| CN | 202595605 | U | 12/2012 |
| CN | 202788849 | U | 3/2013 |
| DE | 2940288 | A1 | 5/1980 |
| DE | 3411602 | A1 | 10/1985 |
| DE | 4322401 | A1 | 1/1995 |
| DE | 29822369 | U1 | 3/1999 |
| DE | 19908656 | C1 | 8/2000 |
| DE | 10161009 | A1 | 11/2002 |
| DE | 202005001311 | U1 | 3/2005 |
| DE | 102005010678 | A1 | 9/2006 |
| DE | 102005017760 | A1 | 10/2006 |
| DE | 102005055544 | A1 | 5/2007 |
| DE | 202007013350 | U1 | 3/2008 |
| DE | 102004030691 | B4 | 12/2008 |
| DE | 10261646 | B4 | 2/2010 |
| DE | 202009014077 | U1 | 4/2010 |
| DE | 102009059189 | A1 | 6/2011 |
| EM | 001848938 | | 4/2011 |
| EP | 0706606 | B1 | 3/1997 |
| EP | 0771911 | A1 | 5/1997 |
| EP | 0997610 | A1 | 5/2000 |
| JP | 4527043 | | 10/1970 |
| JP | 2008503669 | A | 2/2008 |
| KR | 1020050091022 | B1 | 9/2005 |
| TW | 407538 | U | 10/2000 |
| TW | I265836 | B | 11/2006 |
| TW | M326448 | U | 2/2008 |
| TW | M364551 | U1 | 9/2009 |
| TW | M378059 | U | 4/2010 |
| WO | 2006056269 | A1 | 6/2006 |
| WO | 2006119536 | A1 | 11/2006 |
| WO | 2010051593 | A1 | 5/2010 |
| WO | 2011004030 | A2 | 1/2011 |

OTHER PUBLICATIONS

EP 11172525.5 "European Search Report" Dec. 8, 2011, 5 pages.

EP 11172527.1 "European Search Report" Dec. 8, 2011, 5 pages.

Co-pending U.S. Patent Application Publication No. US 2013/0241264 A1 published Sep. 19, 2013 to Lehnert et al.

Co-pending U.S. Patent Application Publication No. US 2013/0241265 A1 published Sep. 19, 2013 to Lehnert et al.

English translation of Notification for the Opinion of Examination with translation of the search report, Taiwanese Application No. 100144345, mailing date Dec. 6, 2013, 4 pp.

First Examination Report with English translation, Chinese Patent Application No. 201110395057.2, Applicant: Wirtgen GmbH, Mailing Date: Jan. 30, 2014, 11 pp.

First Examination Report with English translation, Chinese Patent Application No. 201110394632.7, Applicant: Wirtgen GmbH, Mailing Date: Jan. 28, 2014, 19 pp.

Office Action of Dec. 16, 2014 in co-pending U.S. Appl. No. 13/991,297.

English translation of Notification for the Opinion of Examination issued for Taiwanese Application No. 100144345, mailed on Aug. 18, 2014, 3 pages.

Written Opinion issued for Singapore parallel patent application 2013041637 mailed on Jun. 27, 2014, 13 pages.

Written Opinion and Search Report issued for Singapore application No. 2013042320, dated on Jun. 5, 2014, 19 pages.

First Office Action dated Jan. 28, 2014, in related Chinese patent application No. 201110394632.7, with English translation, 19 pages.

English Translation of Notification for the opinion of Examination and search report from Taiwanese Patent Office mailed May 9, 2014, for related Taiwanese application No. 100144342, 6 pages.

Notification of the First Office Action with English translation, Chinese Patent Application No. 201110395057.2, Applicant: Wirtgen GMBH, Mailing Date: Jan. 30, 2014, 11 pages.

* cited by examiner

CHISEL HOLDER

The invention relates to a bit holder for an earth working machine, in particular a road milling machine, a mining machine, or the like, having a support member onto which an insertion projection is indirectly or directly attached on an insertion projection side, the support member comprising two first and/or two second stripping surfaces that are at an angle to one another, and the support member having a working side that comprises a bit receptacle.

U.S. Pat. No. 3,992,061 discloses a bit holder that forms a support member having an integrally shaped-on insertion projection. The support member is penetrated by a cylindrical bore embodied as a bit receptacle. A working tool, in the present case a round-shank bit, can be inserted into the bit receptacle. The support member comprises two stripping surfaces, at an angle to one another, that serve for bracing against corresponding support surfaces of a base part. The base part comprises an insertion receptacle into which the bit holder can be replaceably inserted with its insertion projection. In the installed state, the stripping surfaces of the bit holder abut against the support surfaces of the base part. A clamping screw that clamps the insertion projection in the insertion receptacle of the base part is used in order to maintain a fixed correlation of surfaces.

During working utilization, the working tool engages into the substrate to be worked, in which context large working forces are transferred. These are transferred from the working tool into the bit holder, where they are passed on via the stripping surfaces into the base part.

The direction and also the magnitude of forces varies during working engagement, under otherwise identical conditions, simply because of the fact that the working tool forms a chip that becomes thicker from the entry point to the exit point (comma-shaped chip). In addition, the force direction and force magnitude vary as a function of different parameters such as, for example, the milling depth, advance, material being worked, etc. The configuration of a bit holder shown in U.S. Pat. No. 3,992,061 cannot discharge the working forces with a sufficiently good service life, especially at high advance speeds. In particular, the stripping surfaces quickly become deflected. In addition, the insertion projection is also exposed to large flexural stresses, creating the risk that an insertion projection breakage will occur after component fatigue.

DE 34 11 602 A1 discloses a further bit holder. This comprises a support member that is braced via projections against a base part. Shaped onto the support member is a clamping part that can be secured to the base part via key connections.

U.S. Pat. No. 4,828,327 presents a bit holder that is configured as a solid block and is penetrated by a bit receptacle. The bit holder furthermore comprises a threaded receptacle that is in alignment with a screw receptacle of a base part. A fastening screw can be passed through the screw receptacle and screwed into the threaded receptacle of the bit holder. Upon tightening of the fastening screw, the bit holder is pulled into an L-shaped recess of the base part and braced there against bracing surfaces.

The bit holders described above are usually arranged protrudingly on the surface of a tubular milling drum. During working utilization, transverse forces also occur that act transversely to the tool advance direction. These transverse forces cannot always be absorbed in sufficiently stable fashion with the bit holders described in U.S. Pat. No. 4,828,327. In particular, these transverse forces are transferred into the fastening screw, which is then highly loaded in shear.

The object of the invention is to create a bit holder of the kind mentioned previously that is notable for an extended service life.

This object is achieved in that the first and/or second stripping surfaces diverge from the insertion projection side toward the working side. The stripping surfaces consequently form a prism-shaped bracing member in the region of the insertion projection side, and enable reliable force transfer there from the bit holder to the base part. As a result of this direct bracing, the loading of the insertion projection during working utilization is also reduced. The arrangement according to the present invention of the stripping surfaces also takes into account the varying force profile typical of earth working tools, so that all in all a longer service life can be achieved.

According to a preferred embodiment of the invention, provision can be made that the lines normal to the first and/or second stripping surfaces point respectively to their bit holder side, viewed in the tool advance direction. The stripping surfaces are thus correspondingly arranged, for example in the context of utilization of the bit holders on a tubular milling drum, with an inclination with respect to the rotation axis of the tubular milling drum. As a result of this arrangement, transverse forces that occur during working utilization can also reliably be intercepted, yielding a further optimization of service life.

Particularly preferably, the first and/or second stripping surfaces enclose an obtuse angle, in particular in the range between 100° and 140°. This angular arrangement ensures that the bit holder can easily be fitted into a base part even at poorly visible locations and in austere construction-site service, so that reliable association of the stripping surfaces with the support surfaces of the base part is guaranteed. This moreover prevents jamming from occurring, even after extended utilization when the stripping surfaces may wear away a little farther with respect to the support surfaces. The bit holder can thus always be replaced easily. In addition, this angled incidence of the first and/or second stripping surfaces guarantees dependable discharge of working forces. The opening angle reflects, in this context, the wide spectrum of directions from which the transverse forces can act in the course of tool engagement and as a result of changes in other parameters.

If, particularly preferably, this angle range between the first stripping surfaces is between 100° and 120°, and/or the angle range between the second stripping surfaces is between 120° and 140°, the tool system is then designed in particularly optimized fashion for road milling applications and the load situations occurring in that context.

A bit holder according to the present invention can be configured in such a way that the stripping surfaces are connected to one another at least in part in the region of the insertion projection side via a transition segment. The stripping surfaces accordingly do not meet one another at the apex of the angle, so that a sharp-edged angular transition that can be damaged is not produced. In addition, a resetting region can also be created with the transition segment and in interaction with the base part. The bit holder can accordingly reset continuously into this resetting space when the stripping surfaces and/or support surfaces of the base part become worn, in which context the stripping surfaces always remain set against the support surfaces. In particular, planar abutment is maintained even if the bit holder needs to be exchanged for a new one, even repeatedly, on an existing base part.

Particularly preferably, the insertion projection is attached onto the insertion projection side at least partly in the region of the stripping surfaces. A direct association between the stripping surfaces and the insertion projection thereby becomes possible, resulting in a smaller component size and moreover an optimized force path.

A bit holder according to the present invention can be characterized in that the longitudinal axis of the insertion projection and the longitudinal center axis of the prisms formed by the first or second stripping surfaces enclose an angle in the range between 100° and 130°. Here as well, this configuration feature results in an optimized force path.

It is also conceivable for the first stripping surfaces to be arranged at least locally in front of the insertion projection in the advance direction, and for the second stripping surfaces to be arranged at least locally behind the insertion projection in the advance direction. This design takes in account especially the varying force profile during working utilization, and the insertion projection is further relieved of working forces.

Provision is preferably made that the first stripping surfaces at least locally form the underside of a front-side skirt. The front-side skirt usually covers a frontal region of the base part and thus protects it from wear. The fact that the front-side skirt is now also used to mount the stripping surfaces yields a compact design, and the bit holder is easy to produce.

Provision can furthermore also be made that the second stripping surfaces at least locally form the underside of a rearward support projection. In certain utilization conditions, a large portion of the forces are transferred via the rearward support projection. In a design that provides on the bit holder a bit receptacle, for example a bore, to receive a working tool, in particular a round-shank bit, provision is made in optimized fashion for the longitudinal center axis of the bit receptacle to be arranged at least locally between the stripping surfaces. The result is on the one hand that a good division of the working forces introduced via the working tool onto both stripping surfaces can be achieved. Furthermore, the bit holder can also be positioned in a different orientation with respect to a tubular milling drum, while reliable force transfer is still maintained.

It has been found that an optimum division, into longitudinal and transverse forces, of the forces to be discharged can be achieved if provision is made that the angle between the longitudinal center axis of the prism of the first stripping surfaces and the longitudinal center axis of the bit receptacle is in the range between 40° and 60°, particularly preferably between 45° and 55°, and/or that the angle between the longitudinal center axis of the prism of the second stripping surfaces and the longitudinal center axis of the bit receptacle is in the range between 70° and 90°, particularly preferably between 75° and 85°. These angular positions also ensure that because of the incidence of the stripping surfaces, the overall width of the bit holder does not become too great, thus guaranteeing a material-optimized design.

According to a further variant embodiment of the invention, provision can be made that the bit receptacle transitions into a flushing conduit, and that the flushing conduit emerges at least locally in the region between the second stripping surfaces. The flushing conduit is thus arranged so that the stripping surfaces do not meet one another at a sharp point.

Particularly preferably, the first and the second stripping surfaces each form a stripping surface pair in which the stripping surfaces are respectively incident in a V-shape. As a result of the V-shaped incidence of the stripping surfaces, prisms in the context of tool apparatus design are formed. These two prisms guarantee stable bracing of the bit holder with respect to the base part. The prisms formed respectively by the first and the second stripping surfaces have a longitudinal center axis. This longitudinal center axis is located in the angle bisector plane that is formed between the two stripping surfaces.

If provision is additionally made that a first stripping surface of the first stripping surface pair and a second stripping surface of the second stripping surface pair are respectively incident to one another an angle preferably in the range between 120° and 160°, and the stripping surface pairs form a support region, the bit holder can then be inserted into a likewise correspondingly configured angled bit holder receptacle of the base part and braced in stable fashion therein. A corresponding arrangement applies to the remaining surfaces of the first and second stripping surface pair, i.e. the two prisms are incident at an angle to one another and again form a prism. The opening angle here reflects the wide spectrum of directions from which the longitudinal forces can act in the course of tool engagement and as a result of changes in other parameters.

It is furthermore conceivable for the longitudinal center axis of the insertion projection to be at an angle in the range from −10° to +10° with respect to the angle bisector of the first and/or of the second stripping surface pair. A uniform preload is thus applied when the bit holder is secured to the base part. Provision is particularly preferably made that the longitudinal center axis of the insertion projection is at an angle in the range from −2° to +2° with respect to the angle bisector of the first and/or of the second stripping surface pair.

A bit holder according to the present invention can also be characterized in that the lines normal to the first and/or second stripping surfaces extend in inclined fashion with respect to the advance direction, so that transverse forces can reliably be transferred.

A particularly preferred configuration of the invention is such that a plane receiving the angle bisector is arranged between the first and/or the second stripping surfaces, and that the insertion projection is arranged symmetrically with respect to that plane. As a result of this symmetrical configuration, the bit holder can also be installed at different installation positions on a tubular milling drum or the like, and this has the advantage that only one variant is needed and it is not necessary to work with left and right bit holders.

In order to reduce stress on the insertion projection and protect it from fatigue breakage, provision is made according to a variant of the invention that the attachment region of the insertion projection onto the support member is arranged, at a proportion of at least 80%, in the region of the stripping surface pair formed by the first stripping surfaces.

The invention will be further explained below with reference to an exemplifying embodiment depicted in the drawings, in which.

Figure 1:
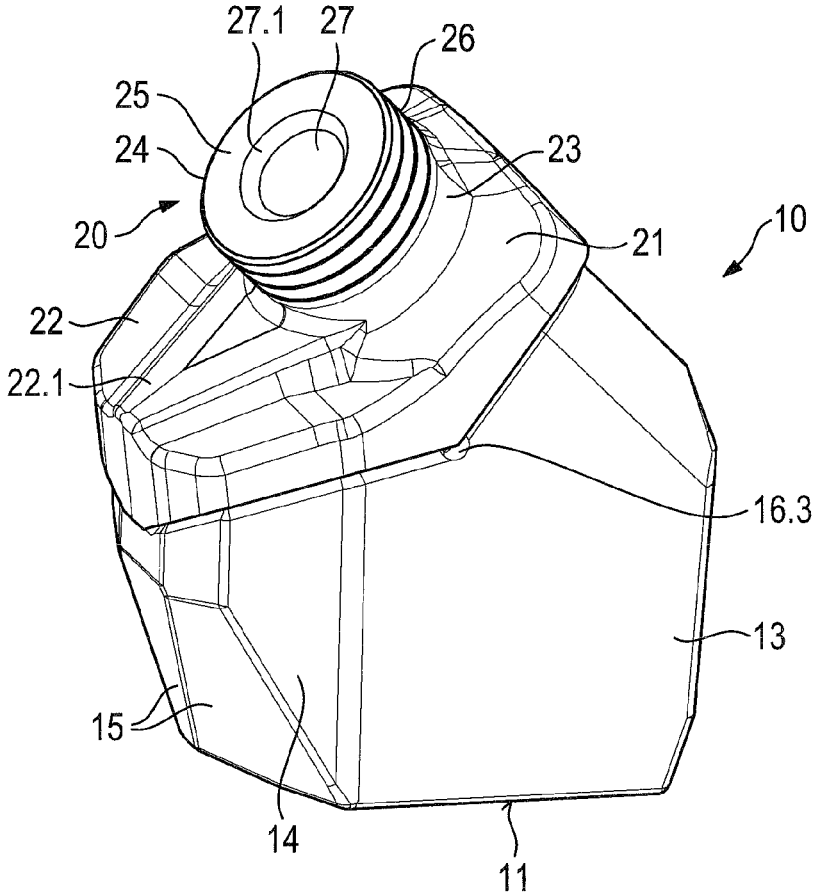
FIG. 1 is a perspective side view of a combination of a base part and a bit holder.

FIG. 1 shows a tool combination made up of a base part 10 and a bit holder 20. Bit holder 20 is connected replaceably to base part 10. Base part 10 comprises a solid basic member 13 that comprises a lower attachment side 11. This attachment side 11 is concavely curved, the curvature being selected in accordance with the outside diameter of a tubular milling drum. Base part 10 can thus be placed with its attachment side 11 onto the outer side of the tubular milling drum and welded in place onto it. Basic member 13 comprises on the front side a projection that is demarcated laterally by oblique surfaces 14 and at the front side by inclined surfaces 15. Inclined surfaces 15 are incident at an angle to one another, and oblique surfaces 14 adjoin inclined surfaces 15 at an angle. This results in an arrow-shaped geometry of base part 10 at the front, leading to better clearing action by base part 10.

Figure 2:
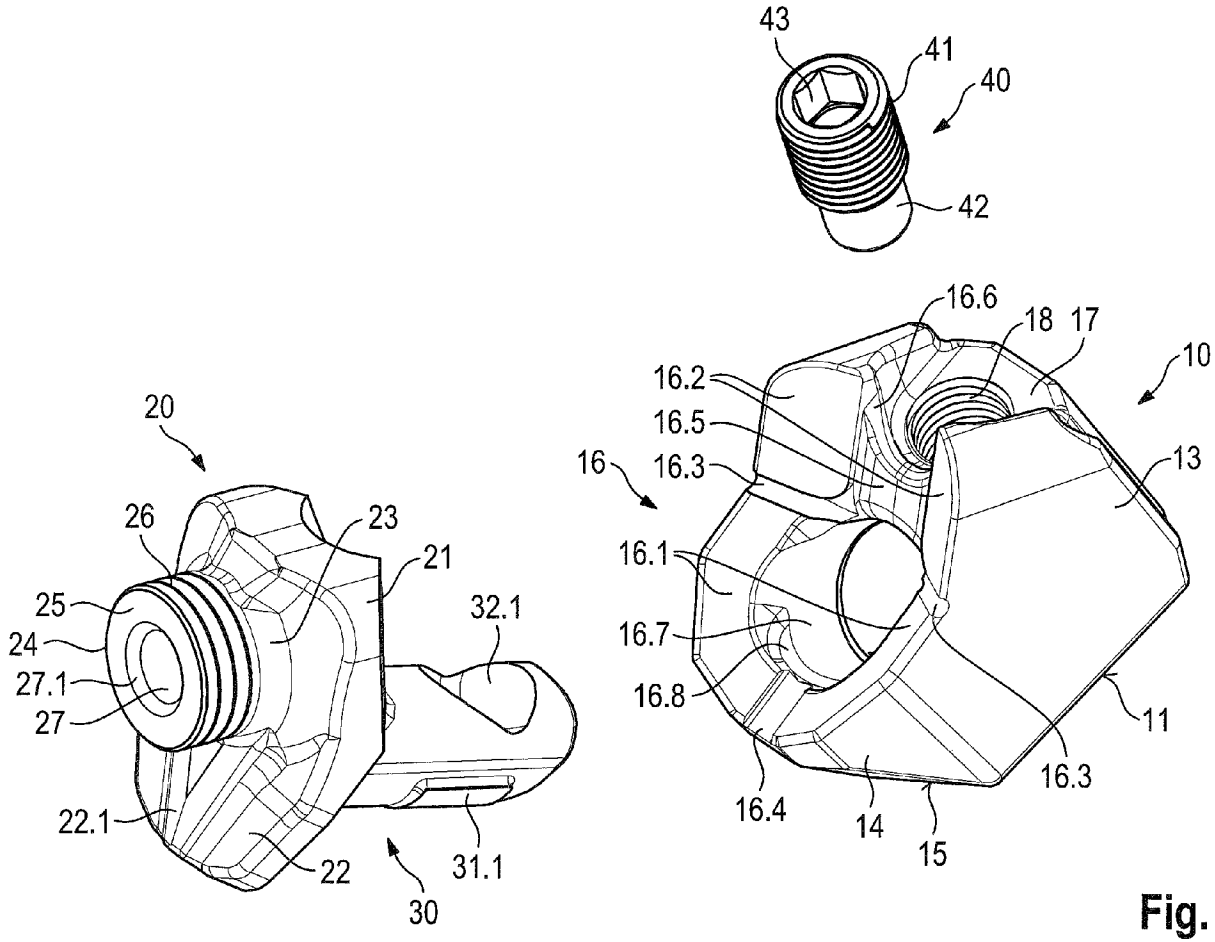
FIG. 2 is an exploded view of what is depicted in FIG. 1.

As FIG. 2 illustrates, a bit holder receptacle 16 having an insertion receptacle 16.7 is recessed into base part 10. Insertion receptacle 16.7 penetrates entirely through basic member 13, and thus opens into attachment side 11. A threaded receptacle 18 that opens into insertion receptacle 16.7 (see FIG. 12) is recessed into base part 10. Bit holder receptacle 16 comprises first support surfaces 16.1 and second support surfaces 16.2. First support surfaces 16.1 form a first support surface pair, and second support surfaces 16.2 form a second support surface pair. In each support surface pair, the respective support surfaces 16.1, 16.2 are arranged at an angle to one another.

Support surfaces 16.1 are furthermore respectively incident at an angle to support surfaces 16.2, resulting in a frustoconical bit holder receptacle 16. Resetting spaces 16.3, 16.4, 16.5 in the form of recesses are provided respectively in the transition region between the individual support surfaces 16.1 and 16.2. A cutout 16.6 that creates a transition from bit holder receptacle 16 to threaded receptacle 18 is furthermore provided in the region of resetting space 16.5.

As is further evident from FIG. 2, a surface 17 that is demarcated laterally by oblique surfaces is formed around the entrance into threaded receptacle 18; the oblique surfaces open divergently toward the back side of base part 10. This creates a capability for easy cleaning of surface 17, and thus of a tool receptacle 43 of a compression screw 40. Compression screw 40 comprises a threaded segment 41 with which it can be screwed into threaded receptacle 18. Compression screw 40 is furthermore embodied with a compression extension 42 in the form of a frustoconical stem that is shaped integrally onto threaded segment 41.

As FIG. 2 further shows, bit holder 20 can be connected to base part 10. Bit holder 20 possesses a support member 21 that is equipped on the front side with a skirt 22. Skirt 22 carries an integrally shaped-on web 22.1 that rises upward proceeding from skirt 22. An extension 23 that terminates in a cylindrical segment 24 is also integrally coupled onto support member 21. Cylindrical segment 24 is provided with wear markings that are embodied in the present case as circumferential grooves 26. Cylindrical segment 24 terminates in a support surface 25 that concentrically surrounds the bore entrance of bit receptacle 27. Bit receptacle 27 transitions via a bevel-shaped introduction segment 27.1 into support surface 25.

Figure 4:
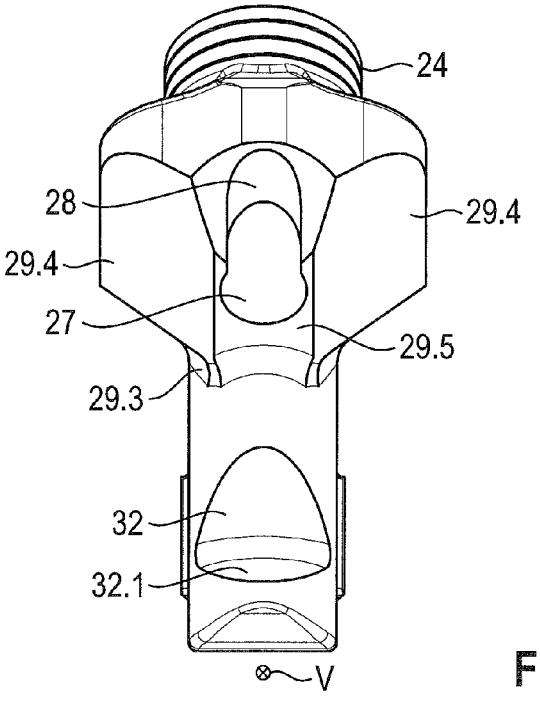
FIG. 4 is a rear view of the bit holder according to FIGS. 1 to 3.

As FIG. 4 shows, bit receptacle 27 is embodied as a passthrough bore. Support member 21 is provided with a back-side cutout that serves as a flushing conduit 28. Flushing conduit 28 consequently opens bit receptacle 27 radially outward in the region of its bore exit. Removed particles that have entered bit receptacle 27 during utilization of the tool can thus be conveyed radially outward through flushing conduit 28.

Figure 3:
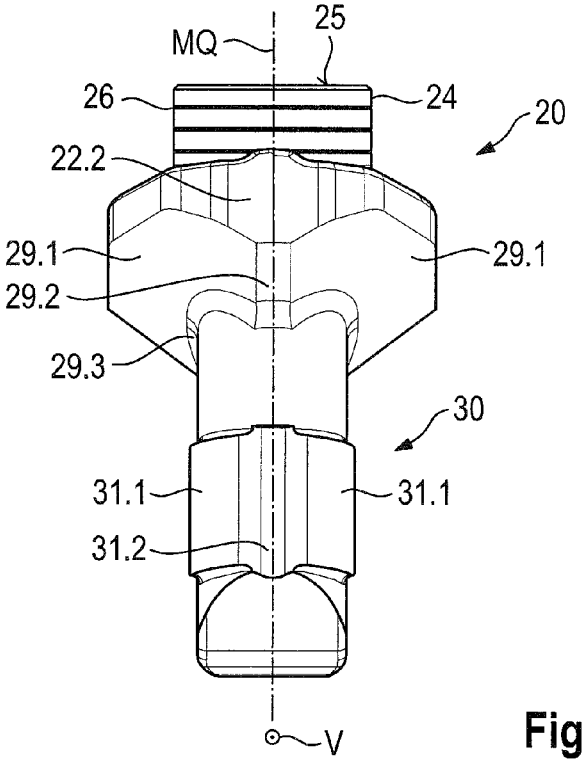
FIG. 3 is a front view of the bit holder according to FIGS. 1 and 2.

It is evident from FIG. 3 that support member 21 comprises first stripping surfaces 29.1 in the region of skirt 22. These stripping surfaces 29.1 are at an oblique angle $\epsilon_1$ to one another (see FIG. 13), and are connected to one another via a transition segment 29.2.

Stripping surfaces 29.1 and 29.4 may also be referred to as bearing surfaces 29.1 and 29.4.

The angle $\epsilon_1$ between first stripping surfaces 29.1 corresponds to the angle between first support surfaces 16.1 of base part 10.

It is evident from FIG. 4 that support member 21 possesses, on the back side, downward-pointing second stripping surfaces 29.4. Second stripping surfaces 29.4 are at an angle $\epsilon_2$ to one another (see FIG. 14); here as well, the angle $\epsilon_2$ between second stripping surfaces 29.4 corresponds to the angle between second support surfaces 16.2 of base part 10. While first stripping surfaces 29.1 transition into one another by means of transition segment 29.2, a transition region between the two stripping surfaces 29.4 is formed by flushing conduit 28 and a transition segment 29.5.

Stripping surfaces 29.1 and 29.4 each form stripping surface pairs in the shape of a prism. These prisms have a longitudinal center axis MLL that is formed in the angle bisector plane between the two first stripping surfaces 29.1 and second stripping surfaces 29.4, respectively. These angle bisector planes are labeled "WE" in FIGS. 13 and 14. The longitudinal center axis is indicated there as MLL; in principle, longitudinal center axis MLL can be located at any position within the angle bisector plane.

Figure 13:
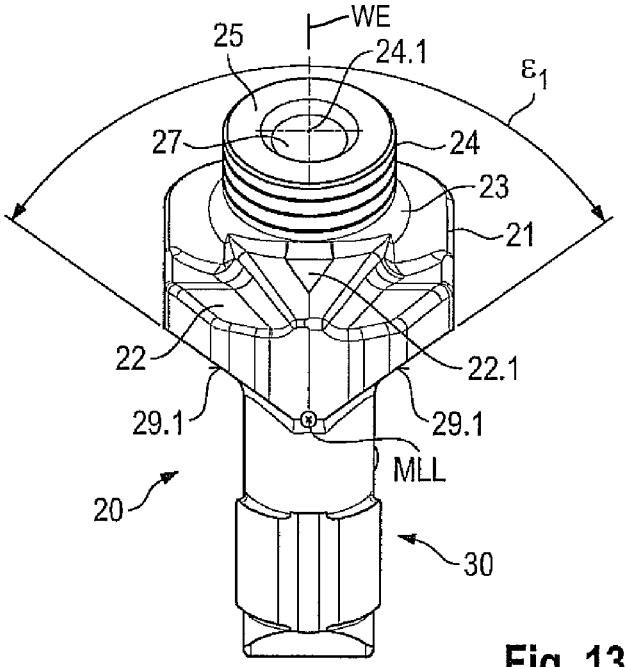
FIG. 13 is a view from the front of the bit holder according to FIG. 5.
Figure 14:
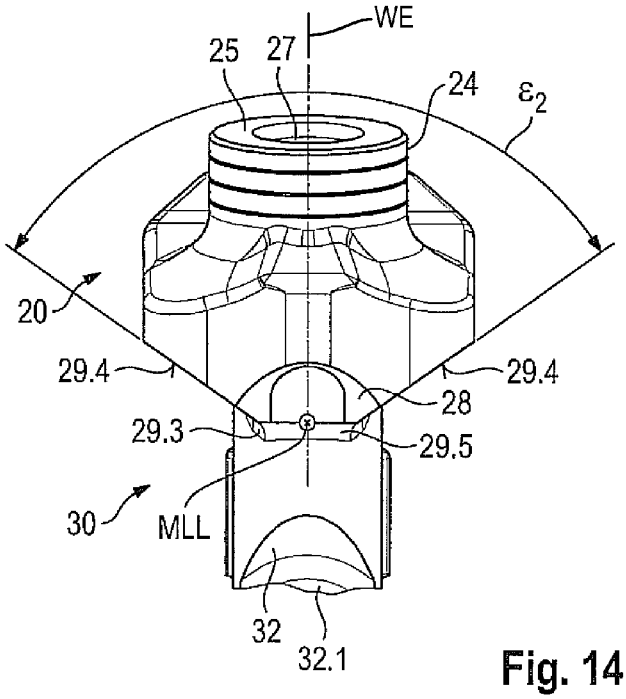
FIG. 14 is a view from behind of the bit holder.

FIGS. 3 and 4, in conjunction with FIGS. 13 and 14, show that first stripping surfaces 29.1 and also second stripping surfaces 29.4 diverge proceeding from the insertion projection side toward the working side. In the present example, the lines normal to stripping surfaces 29.1, 29.4 correspondingly converge from the insertion projection side toward the working side. The surface normal lines consequently converge in the region of the tool engagement point at which working forces are introduced into the tool system.

The use of two stripping surface pairs having the respective first and second stripping surfaces 29.1 and 29.4 takes optimally into account the variation in working forces during tool engagement. A comma-shaped chip is produced during tool engagement. Not only the force magnitude but also the force direction changes as this chip is formed. Correspondingly, at the beginning of tool engagement the working force acts in such a way that it is dissipated more via the stripping surface pair formed by first stripping surfaces 29.1. As tool engagement progresses, the direction of the working force rotates and it is then dissipated increasingly via the stripping surface pair formed by second stripping surfaces 29.4. The angle $\gamma'$ (see FIG. 5) between the stripping surface pairs must therefore be embodied so that the variation in working force is taken into consideration, and so that this working force always acts into the prisms formed by the stripping surface pairs.

Figure 9:
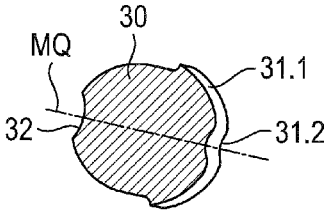
FIG. 9 shows a section marked IX-IX in FIG. 7.
Figure 10:
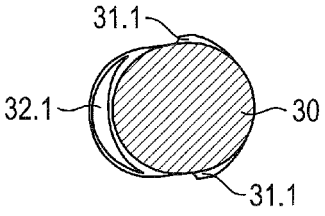
FIG. 10 shows a section marked X-X in FIG. 7.
Figure 11:
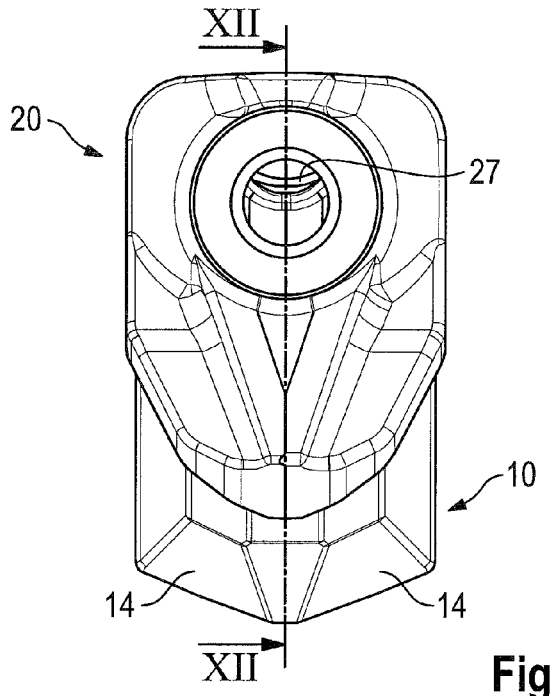
FIG. 11 is a plan view of the tool combination according to FIG. 1.

The central transverse plane MQ of bit holder 20 is labeled in FIGS. 3 and 9. The bit holder is constructed mirror-symmetrically with respect to this central transverse plane MQ, so that it can be installed on a milling drum as a right-hand or left-hand part.

The advance direction is characterized in FIGS. 3 and 4 with usual arrow indications. The bit holder sides are arranged transversely to the advance direction. The lines normal to stripping surfaces 29.1 and 29.4 thus each point downward and toward their side (viewed in the tool advance direction) of the bit holder, as is clear from FIGS. 3 and 4. This situation is shown again in FIG. 5 in a side depiction.

Figure 5:
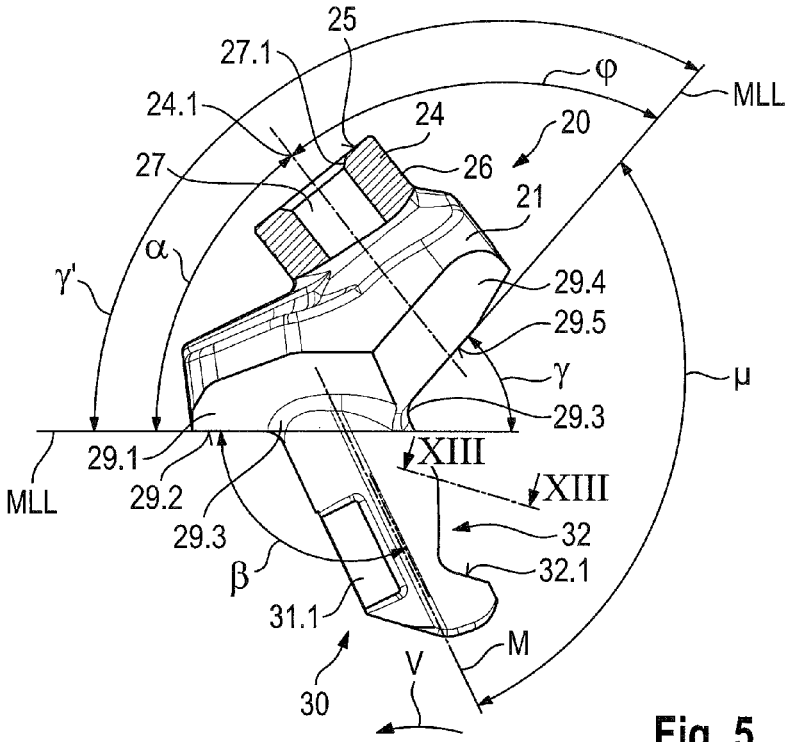
FIG. 5 is a side view from the left of the bit holder according to FIGS. 1 to 4.

The working force acts, however, not only in the direction of the image plane according to FIG. 5, but also in a transverse direction. These transverse force components are then ideally intercepted by the angled incidence ($\epsilon_1$, $\epsilon_2$) of stripping surfaces 29.1, 29.4.

Because the working forces exhibit less variation in the transverse direction at the beginning of tool engagement, angle $\epsilon_1$ can also be selected to be smaller than $\epsilon_2$.

FIG. 5 further shows that an insertion projection 30 is shaped integrally onto support member 21 and transitions via a fillet transition 29.3 into first stripping surfaces 29.1 and second stripping surfaces 29.4. Insertion projection 30 is arranged so that it adjoins support member 21 substantially (at a proportion of approximately 90% in the present case) in the region of first stripping surfaces 29.1. Insertion projection 30 carries two abutment surfaces 31.1 on the front side. As is evident from FIG. 3, these are embodied as convexly curved cylindrical surfaces. Abutment surfaces 31.1 extend along and parallel to longitudinal center axis M (see FIG. 5) of insertion projection 30. Abutment surfaces 31.1 are thus also parallel to one another. Abutment surfaces 31.1 are arranged at a distance from one another in the circumferential direction of insertion projection 30. They have the same radius of curvature and are arranged on a common reference circle. The radius of curvature corresponds to half the reference circle diameter. A recess 31.2 is provided in the region between abutment surfaces 31.1, and abutment surfaces 31.1 extend parallel to recess 31.2. The recess can have a wide variety of shapes; for example, it can be simply a flat-milled surface. In the present exemplifying embodiment, recess 31.2 forms a hollow that is hollowed out in concave fashion between abutment surfaces 31.1. The concavity is designed so that a partly-cylindrically shaped geometry results. Recess 31.2 extends not over the entire length of insertion projection 30 but instead only over a sub-region, as is evident from FIG. 13. Recess 31.2 is open toward the free end of insertion projection 30, i.e. in the insertion direction. Recess 31.2 also opens up radially outward with no undercut. Insertion projection 30 comprises on the back side, located opposite abutment surfaces 31.1, a compression screw receptacle 32 that is equipped with a pressure surface 32.1.

Figure 6:
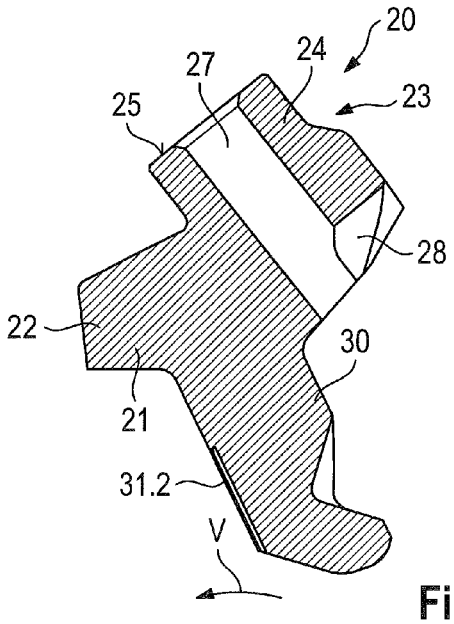
FIG. 6 is a vertical section, through the central transverse plane of the bit holder, of what is depicted in FIG. 5.

FIGS. 6 and 9 illustrate that recess 31.2 has a concavely inwardly curved geometry between the two abutment surfaces 31.1, and in particular can form a partly-cylindrically shaped cross section.

Figure 7:
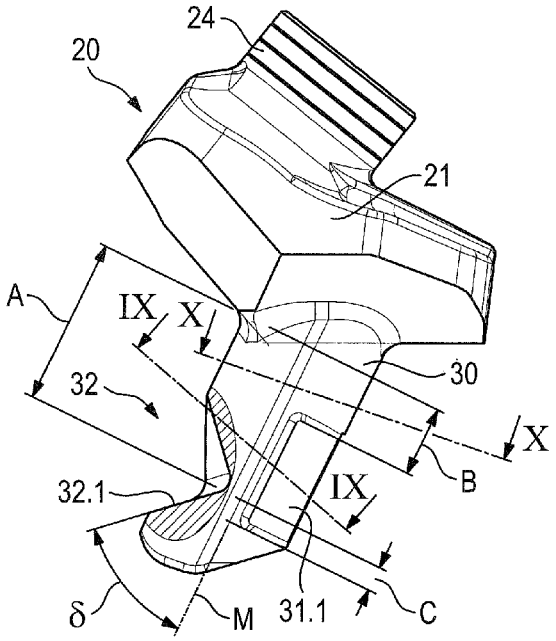
FIG. 7 is a side view from the right, partly in section, of the bit holder according to FIGS. 1 to 6.
Figure 8:
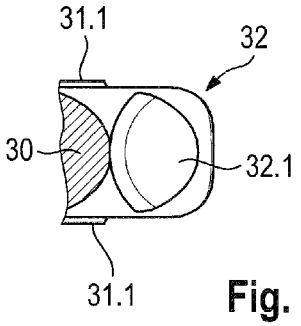
FIG. 8 shows a section marked VIII-VIII in FIG. 5.

FIGS. 7 to 10 depict in more detail the configuration of insertion projection 30. FIG. 9 clearly shows the concave inward curvature of recess 31.2 that adjoins the convex abutment surfaces 31.1. It is clear from FIG. 10 that insertion projection 30 has, in its region adjoining abutment surfaces 31.1, a substantially circular or oval cross-sectional conformation. FIG. 8 illustrates the region of compression screw receptacle 32, pressure surface 32.1 being incident at an angle δ to longitudinal center axis M of insertion projection 30. This angle of incidence δ is preferably in the range between 20° and 60° in order to achieve an optimum draw-in effect for bit holder 20.

FIG. 7 furthermore shows that pressure surface 32.1 is arranged at a distance equal to distance dimension A from the attachment region of insertion projection 30 onto support member 21.

Abutment surfaces 31.1 are arranged at a distance equal to distance dimension B from the attachment region of insertion projection 30 onto support member 21. The surface centroid of abutment surfaces 31.1 is arranged at a distance equal to distance dimension C from the surface centroid of pressure surface 32.1.

For installation of bit holder 20 into base part 10, insertion projection 30 is inserted into insertion receptacle 16.7. The insertion motion is limited by the first and second stripping surfaces 29.1, 29.4 that come to a stop against first and second support surfaces 16.1, 16.2.

Figure 12:
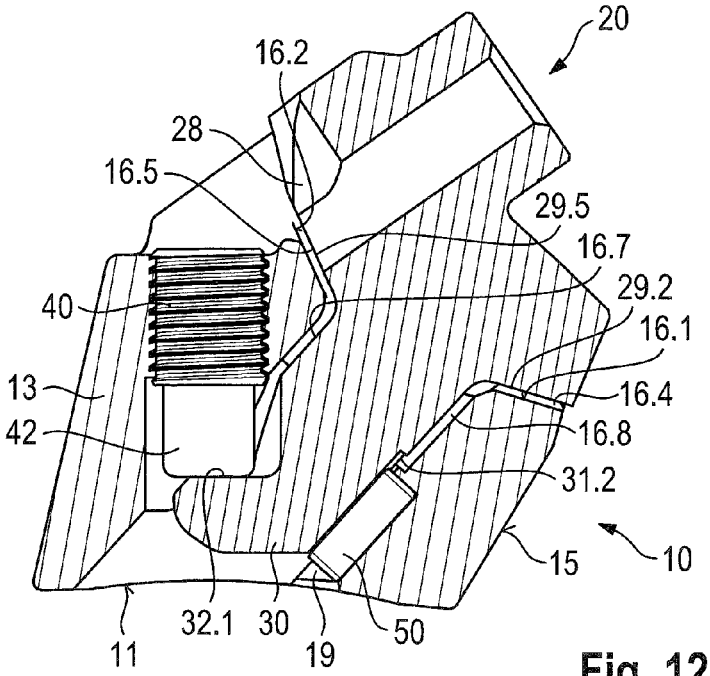
FIG. 12 shows a section marked XII-XII in FIG. 11.

As may be gathered from FIGS. 1 and 12, the correlation here is such that transition segment 29.2 extends beyond resetting space 16.4, resetting space 16.5 is spanned by transition segment 29.5, and the lateral resetting spaces 16.3 are spanned by the angled region that is formed between first and second stripping surfaces 29.1, 29.4. The result of the fact that bit holder 20 is distanced in the region of these resetting spaces 16.3, 16.4, 16.5 is that during working utilization, bit holder 20 can reset into resetting spaces 16.3, 16.4, 16.5 when stripping surfaces 29.1, 29.4 and/or support surfaces 16.1, 16.2 wear away. This is the case in particular when worn bit holders 20 are to be replaced with new ones, on an existing base part 10. To fix in place the installation state described above, compression screw 40 is screwed into threaded receptacle 18. Compression extension 42 thereby presses with its flat end surface onto pressure surface 32.1 and thus produces a draw-in force that acts in the direction of longitudinal center axis M of insertion projection 30. At the same time, however, compression screw 40 is incident at an angle to longitudinal center axis M of insertion projection 30 such that a clamping force acting toward the front side is also introduced into insertion projection 30. This clamping force is transferred via abutment surfaces 31.1 into the corresponding concave counter-surface of the cylindrical segment of insertion receptacle 16.7. The fact that abutment surfaces 31.1 are distanced via recess 31.2 guarantees that insertion projection 30 is reliably immobilized by way of the two bracing regions formed laterally by abutment surfaces 31.1. The result is, in particular, that the surface pressures which occur are also kept low as a result of the two abutment surfaces 31.1, leading to reliable immobilization of insertion projection 30.

Effective wear compensation can be implemented by the fact that bit holder 20 can reset into resetting spaces 16.3, 16.4, 16.5 in the event of wear; stripping surfaces 29.1, 29.4 extend beyond support surfaces 16.1, 16.2 at every point, so that in the event of erosion, support surfaces 16.1, 16.2 are in any case eroded uniformly without producing a "beard" or burr. This configuration is advantageous in particular when, as is usually required, base part 10 has a service life that extends over several life cycles of bit holders 20. Unworn bit holders 20 can then always be securely fastened and retained even on a base part 10 that is partly worn. It is thus also simple to repair a machine in which the tool system constituted by base part 10 and bit holder 20 is used. It is usual for a plurality of tool systems to be installed on such a machine, for example a road milling machine or surface miner, the base part usually being welded onto the surface of a tubular milling drum. When all or some of bit holders 20 are then worn, they can easily be replaced with new unworn or partly worn bit holders 20 (which can be used e.g. for rough clearing operations).

For replacement, firstly compression screw 40 is loosened. The worn bit holder 20 can then be pulled with its insertion projection 30 out of insertion receptacle 16.7 of base part 10, and removed. The new (or partly worn) bit holder 20 is then inserted with its insertion projection 30 into insertion receptacle 16.7 of base part 10. Compression screw 40 can then be replaced, if necessary, with a new one. It is then screwed into base part 10 and secured to bit holder 20 in the manner described.

It is evident from FIG. 12 that base part 10 carries a projection 50 that protrudes into insertion receptacle 16.7. This projection 50 is constituted in the present case by a cylindrical pin that is driven from attachment side 11 into a partly-cylindrical recess 19. Partly-cylindrical recess 19 surrounds the cylindrical pin over more than 180° of its circumference, so it is retained in lossproof fashion. That region of the cylindrical pin which protrudes into bit receptacle 27 engages into recess 31.2 between abutment surfaces 31.1. Upon insertion of insertion projection 30 into insertion receptacle 16.7, protrusion 50 threads reliably into recess 31.2 that is open toward the free end of insertion projection 30. Alignment of bit holder 20 with respect to base part 10 is thereby achieved. This alignment ensures that first and second stripping surfaces 29.1, 29.4 now come into accurately fitted abutment against support surfaces 16.1, 16.2 so that incorrect installation is precluded. In addition, the lock-and-key principle of projection 50, and of recess 31.2 adapted geometrically to it, prevents an incorrect bit holder 20 from inadvertently being installed on base part 10.

The angular correlations of bit holder 20 according to the present invention will be discussed in further detail below.

It is evident from FIG. 5 that longitudinal center axis 24.1 of bit receptacle 27 is at a respective angle $\alpha$ and $\phi$ to the longitudinal orientations of transition segments 29.2 and 29.5, and thus also to longitudinal center axis MLL of the prisms formed by first stripping surfaces 29.1 and by second stripping surfaces 29.4, respectively. The angle $\alpha$ can be between 40° and 60°, and the angle $\phi$ in the range between 70° and 90°.

FIG. 5 further shows that in a projection of stripping surfaces 29.1 and 29.4 into a plane perpendicular to the advance direction (said projection corresponding to FIG. 5), stripping surfaces 29.1 and 29.4 are angled with respect to one another at an angle $\gamma$ in the range between 40° and 60°, and that the opening angle between transition segments 29.2 and 29.5 in the longitudinal orientation according to FIG. 5 is between 120° and 140°. The angle $\gamma'$ between longitudinal center axes MLL of the two prisms formed by stripping surfaces 29.1 and 29.4 (stripping surface pairs) is correspondingly in the range between 120° and 140°. Furthermore, in a projection of this kind of stripping surfaces 29.1, 29.4, first stripping surfaces 29.1 are at an angle 13, and second stripping surfaces at an angle $\mu$, to longitudinal center axis M of insertion projection 30. The same also applies here to longitudinal center axes MLL of the prisms. The angles $\beta$ and $\mu$ can be in the range between 100° and 130°, preferably in the range between 110° and 120°.

FIG. 13 shows that first stripping surfaces 29.1 enclose an angle $\epsilon_1$. This angle $\epsilon_1$ should preferably be in the range between 100° and 120°. The angle bisector of this angle $\epsilon_1$ is located in a plane, and FIG. 13 illustrates that insertion projection 30 is arranged symmetrically with respect to that plane.

In the same manner, the rear second stripping surfaces 29.4 are correspondingly also incident to one another at an angle $\epsilon_2$, as shown in FIG. 14. The angle $\epsilon_2$ can, however, differ from angle $\epsilon_1$, and in the present exemplifying embodiment can be between 120° and 140°, and insertion projection 30 is also arranged and equipped symmetrically with respect to the angle bisector plane of said angle $\epsilon_2$.

Figure 15:
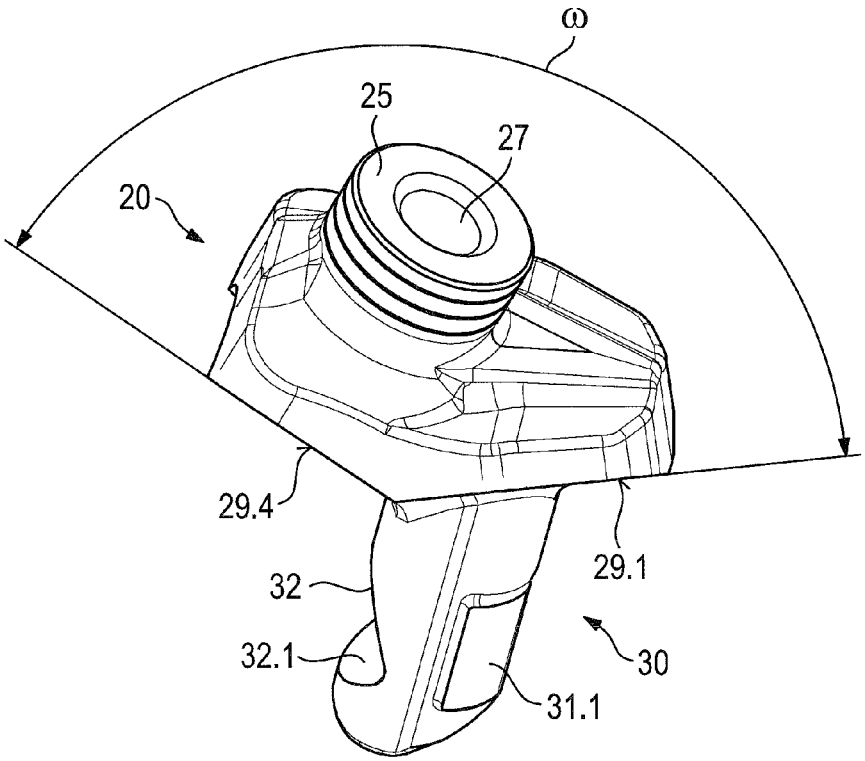
FIG. 15 is a rotated side view of the bit holder.

FIG. 15 shows that a first stripping surface 29.1 of the first stripping surface pair and a second stripping surface 29.4 of the second stripping surface pair are respectively incident to one another at an angle $\omega$, and form a support region.

The invention claimed is:

1. A tool apparatus for an earth working machine, comprising:

an insertion projection having a longitudinal insertion axis; and a support member having an insertion projection side and a working side, the insertion projection extending from the insertion projection side, the working side facing away from the insertion projection, the support member including:

two first bearing surfaces at a first angle to one another, the two first bearing surfaces diverging from the insertion projection side toward the working side; and two second bearing surfaces at a second angle to one another, the two second bearing surfaces diverging from the insertion projection side toward the working side;

wherein:

the two first bearing surfaces are arranged at least partly in front of the longitudinal insertion axis with reference to a tool advance direction; and the two second bearing surfaces are arranged at least partly behind the longitudinal insertion axis with reference to the tool advance direction.

2. The apparatus of claim 1, wherein:

the working side includes a bit receptacle;

the two first bearing surfaces are generally on a first side of the bit receptacle with reference to the tool advance direction, and the two second bearing surfaces are generally on a second side of the bit receptacle with reference to the tool advance direction; and lines normal to and projecting outward from the two first bearing surfaces point in the tool advance direction and lines normal to and projecting outward from the two second bearing surfaces point away from the tool advance direction.

3. The apparatus of claim 1, wherein:

the first angle is in a range of from 100° to 120°; and the second angle is in a range of from 120° to 140°.

4. The apparatus of claim 1, wherein:

the two first bearing surfaces are connected to each other at least partly on the insertion projection side by a first transition segment; and the two second bearing surfaces are connected to each other at least partly on the insertion projection side by a second transition segment.

5. The apparatus of claim 1, wherein:

the insertion projection is attached to the insertion projection side of the support member at least partially in a region of the two first bearing surfaces and the two second bearing surfaces.

6. The apparatus of claim 1, wherein:

planes defined by the two first bearing surfaces intersect at a first longitudinal center bearing axis;

planes defined by the two second bearing surfaces, intersect at a second longitudinal center bearing axis;

the longitudinal insertion axis and the first longitudinal center bearing axis enclose an angle in a range of from 100° to 130°; and the longitudinal insertion axis and the second longitudinal center bearing axis enclose an angle in a range of from 100° to 130°.

7. The apparatus of claim 1, wherein:

the support member includes a front-side skirt with reference to the tool advance direction; and the two first bearing surfaces at least partly locally form an underside of the front-side skirt.

8. The apparatus of claim 1, wherein:

the support member includes a rearward support projection with reference to the tool advance direction; and the two second bearing surfaces at least partly locally form an underside of the rearward support projection.

9. The apparatus of claim 1, wherein:

the working side includes a bit receptacle; and the bit receptacle includes a longitudinal center receptacle axis arranged between the two first bearing surfaces and between the two second bearing surfaces.

10. The apparatus of claim 1, wherein:

the working side includes a bit receptacle;

the bit receptacle has a longitudinal center receptacle axis;

planes defined by the two first bearing surfaces intersect at a first longitudinal center bearing axis; and the longitudinal center receptacle axis and the first longitudinal center bearing axis enclose an enclosed angle in a range of from 40° to 60°.

11. The apparatus of claim 10, wherein:

the enclosed angle is in a range of from 45° to 55°.

12. The apparatus of claim 1, wherein:

the working side includes a bit receptacle;

the bit receptacle has a longitudinal center receptacle axis;

planes defined by the two second bearing surfaces intersect at a second longitudinal center bearing axis; and the longitudinal center receptacle axis and the second longitudinal center bearing axis enclose an enclosed angle in a range of from 70° to 90°.

13. The apparatus of claim 12 wherein:

the enclosed angle is in a range of from 75° to 85°.

14. The apparatus of claim 1, wherein:

the working side includes a bit receptacle;

the support member further includes a flushing conduit defined therein;

the bit receptacle transitions into the flushing conduit; and the flushing conduit emerges at least partly in a region between the two second bearing surfaces.

15. The apparatus of claim 1, wherein:

the two first bearing surfaces form a first bearing surface pair, planes of the two first bearing surfaces being incident in a V-shape; and the two second bearing surfaces form a second bearing surface pair, planes of the two second bearing surfaces being incident in a V-shape.

16. The apparatus of claim 15, wherein:

a plane of one of the first bearing surfaces and a plane of one of the second bearing surfaces intersect to define an angle in a range of from 120° to 160°.

17. The apparatus of claim 15, wherein:

the longitudinal insertion axis is at an angle of from −10° to +10° with respect to an angle bisector plane of the two first bearing surfaces.

18. The apparatus of claim 1, wherein:

lines normal to the two first bearing surfaces and the two second bearing surfaces are all inclined relative to a tool advance direction.

19. The apparatus of claim 1, wherein:

an angle bisector plane bisects the first angle and the second angle, and the insertion projection is symmetrical about the angle bisector plane.

20. The apparatus of claim 1, wherein:

at least 80% of a region of attachment of the insertion projection to the support member intersects with the first pair of bearing surfaces.

* * * * *

UNITED STATES PATENT AND TRADEMARK OFFICE

CERTIFICATE OF CORRECTION

PATENT NO. : 9,151,157 B2
APPLICATION NO. : 13/822895
DATED : October 6, 2015
INVENTOR(S) : Lehnert et al.

It is certified that error appears in the above-identified patent and that said Letters Patent is hereby corrected as shown below:

Claims

Column 11, line 1, claim 7, after "partly" delete "locally".
Column 11, line 6, claim 8, after "partly" delete "locally".

Signed and Sealed this
Eighth Day of March, 2016

Michelle K. Lee

Michelle K. Lee
*Director of the United States Patent and Trademark Office*